US005212844A

United States Patent [19]

Sessions et al.

[11] Patent Number: 5,212,844

[45] Date of Patent: * May 25, 1993

[54] POCKET TOOL WITH RETRACTABLE JAWS

[75] Inventors: George C. Sessions; Chuck D. Mills, both of Milwaukie; Bradford J. Parrish, Oregon City; Douglas R. Hutchens, Lake Oswego, all of Oreg.

[73] Assignee: Fiskars Oy Ab, Helsinki, Finland

[ * ] Notice: The portion of the term of this patent subsequent to Sep. 1, 2009 has been disclaimed.

[21] Appl. No.: 921,307

[22] Filed: Jul. 28, 1992

Related U.S. Application Data

[63] Continuation-in-part of Ser. No. 666,367, Mar. 8, 1991, Pat. No. 5,142,721.

[51] Int. Cl.[5] ..... B25B 7/22

[52] U.S. Cl. ..... 7/128; 81/416; 30/162

[58] Field of Search ..... 7/127, 128; 81/300, 81/415, 416, 418, 427.5; 30/152, 162

[56] References Cited

U.S. PATENT DOCUMENTS

| | | | |
|---|---|---|---|
| 542,601 | 7/1895 | Baker . | |
| 4,238,862 | 12/1980 | Leatherman | 7/128 |
| 4,502,220 | 3/1985 | Aoki | 30/162 |
| 4,744,272 | 5/1988 | Leatherman | 7/128 X |
| 5,062,173 | 11/1991 | Collins et al. . | |

*Primary Examiner*—James G. Smith
*Attorney, Agent, or Firm*—Foley & Lardner

[57] ABSTRACT

The present invention is a combination tool that includes a pair of retractable jaws capable of being moved into an exposed operating position by inertial force using a single hand. The tool includes a single compact unit with, on one end of the handles, pivoted jaws sliding into and out of the handles and, at the distal end of the handles, a selected group of pivotally attached tools that perform various functions. Each of these pivotally attached tools is housed within one of the handles when not in use.

16 Claims, 4 Drawing Sheets

POCKET TOOL WITH RETRACTABLE JAWS

CROSS REFERENCE TO RELATED APPLICATION

This is a continuation-in-part application from copending U.S. patent application Ser. No. 07/666,367 filed Mar. 8, 1991 now U.S. Pat. No. 5,142,721.

FIELD OF THE INVENTION

The present invention relates to a pocket tool with retractable pliers capable of being moved and locked into an exposed operating position by inertial, e.g., centrifugal, force using a single hand. More particularly, the present invention relates to a multi-function pocket tool which includes, in a single, compact unit, slidable jaws and various other selected tools.

BACKGROUND OF THE INVENTION

In general, multi-function tools, including in a single instrument, pliers, and other selected tools, such as screwdrivers, knife blades, files, scissors and the like are well known. The prior art tools typically include a cross-jaw pliers with channel-shaped handles pivotally connected to the shanks (tangs) of the respective plier jaws. The handles fold over the pliers so that the pliers are received in the handle channels. Respective tools, channel-shaped handle extensions, or both, are pivotally mounted to each handle at the distal end, adapted to fall into the handle channel or nest within the handle, respectively, for storage. Examples of such multiple tools are described in U.S. Pat. Nos. 4,238,862, 4,744,272, and 4,888,869, issued on Dec. 16, 1980, May 17, 1988, and Dec. 26, 1989, respectively, to Timothy S. Leatherman, and U.S. Pat. No. 5,062,173 issued Nov. 5, 1991 to Collins.

The tools disclosed in the Leatherman patents are disadvantageous in that the use of both hands is required to unfold the handles from the nested storage position to expose the plier jaws. Likewise, both hands are required to return the plier jaws to the nested storage position. This tends to limit the utility of the tool in some circumstances. In addition, when the handles are unfolded from the pliers, the open channel in which the pliers are received when in a folded position face outwardly. Thus, unless special provisions are made, typically involving the additional step of unfolding or pivoting a handle extension or sleeve, the open edges of the channel sides address the user's hand. This makes the pliers particularly uncomfortable to use.

Mechanisms for locking the handles of such tools in a particular position are also known. An example of such a locking mechanism is disclosed in the aforementioned U.S. Pat. No. 4,238,862 to Leatherman. However, such mechanisms typically must be specifically released before the handles can be further opened, and, thus, are not particularly suitable for maintaining the handles in a closed position when the pliers are stored or an ancillary tool is in use.

Although the tool disclosed in the Collins patent comprises pliers which are rotatably mounted in the recess of the handles and which may arguably be exposed in a single hand motion, the tool has other disadvantages. More specifically, this tool, having pliers designed for use in a range of positions at an angle from the handles as well as fully extended, do not allow locking of the pliers in operating position to prevent movement of the pliers with respect to the handles.

SUMMARY OF THE INVENTION

The present invention provides a multi-function tool including jaws which can be selectively stored within the handles thereof, and can be exposed and locked in operating position, or retracted for storage, employing only one hand.

In accordance with another aspect of the present invention, the respective handles can be locked in a closed position to present a comfortable handle for use of a selected ancillary tool, which handle is automatically released when the jaws are exposed.

Preferably, this is accomplished by slidably affixing the shanks (tangs) of a set of jaws to respective handles, such that the jaws can be slidably retracted into the interior of the handle channels. When the jaws are retracted, the handles obstruct pivotal movement of the jaws, preventing the jaws, and hence the handles, from opening. The centrifugal force generated by a flip of the wrist causes the jaws to slide forward and to lock into an exposed position. Preferably, the handles are also pivotally connected, separately from the jaws. When the jaws are extended, the hinge points (pivot axes) of jaws and handles align. When the jaws are retracted, the hinge points misalign, further preventing the handles from opening.

BRIEF DESCRIPTION OF THE DRAWINGS

A preferred exemplary embodiment of the present invention will hereinafter be described in conjunction with the appended drawing, wherein like designations denote like elements, and.

DETAILED DESCRIPTION OF A PREFERRED EXEMPLARY EMBODIMENT

Figure 2:
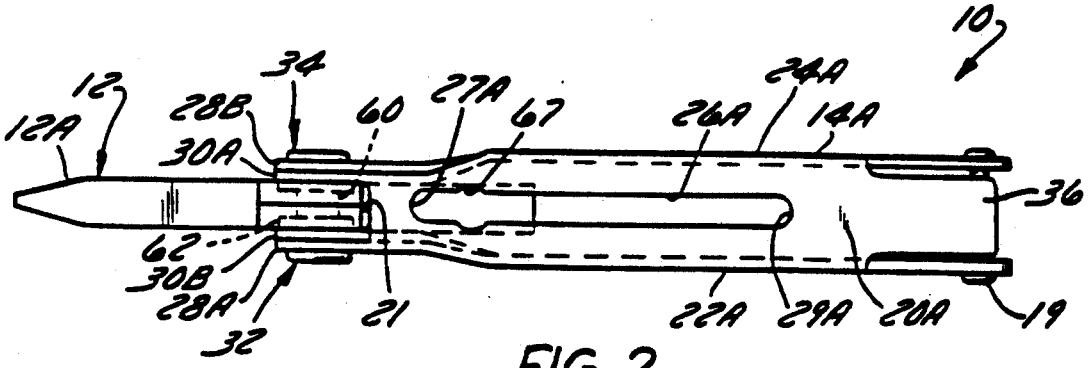
FIG. 2 is a schematic top view of a second embodiment tool in accordance with the present invention, with jaws exposed.
Figure 3:
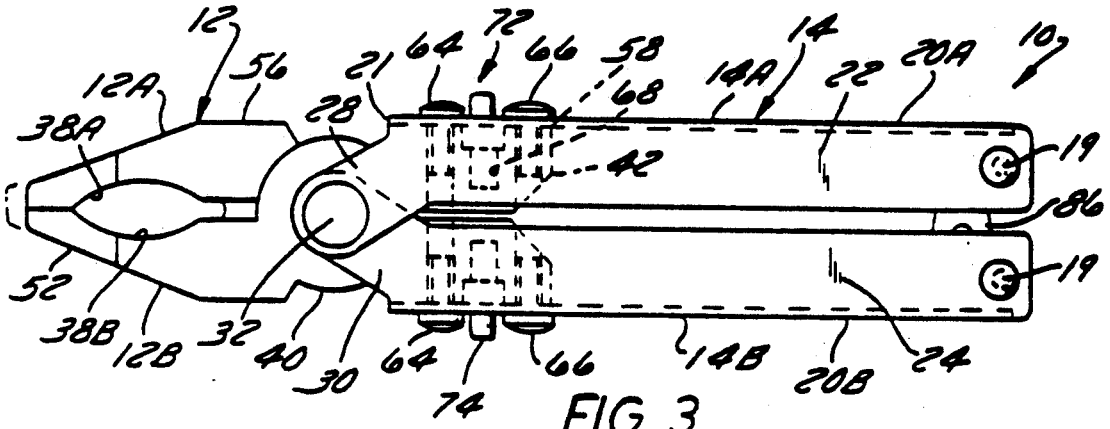
FIG. 3 is a schematic side view of the tool of FIG. 2.
Figure 4:
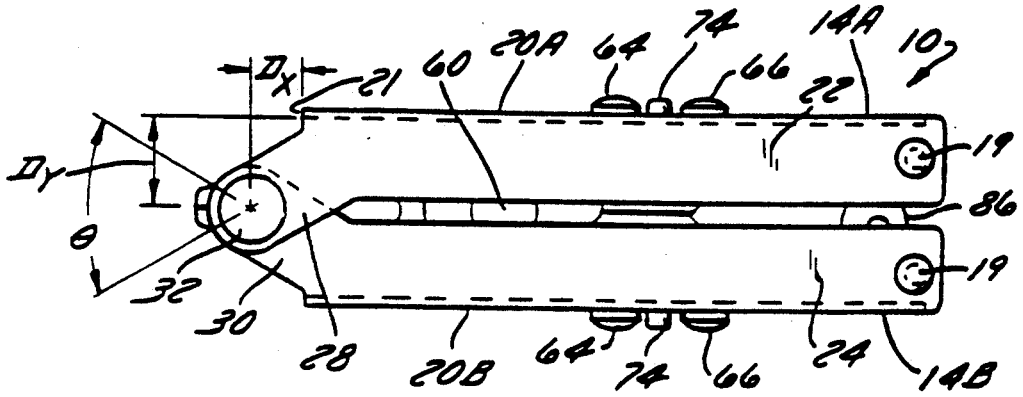
FIG. 4 is a schematic side view of the tool of FIG. 3, with jaws retracted.

Referring to FIGS. 1–4, a tool 10 in accordance with the present invention suitably includes a pair of jaws 12, respective channel-shaped handles 14A and 14B (generally referred to as handle 14) and, if desired, one or more selected tools, generally indicated as 18. As will hereinafter be explained, jaws 12 are adapted to selectively retract into handles 14 when closed; jaws 12 selectively assume a fully extended (active) position (FIGS. 1–3) or a retracted position (FIG. 4). In the extended position jaws 12 are capable of pivotal movement with respect to each other in response to divergence and convergence of handles 14. In the retracted position handles 14 are prevented from opening. Ancillary tools 18 are suitable pivotally mounted to the distal ends of handles 14.

Handles 14A and 14B are preferably substantially identical, and will be described in terms of generically denominated components. Where reference is made to a component associated with a particular one of handles 14A and 14B, and "A" or "B" suffix, respectively, will be used. Handles 14 are channel-shaped; a web 20 connects respective side panels 22 and 24. The interior wall of web 20 defines the transverse dimension of the handle channel. Web 20 is generally flat, and includes a substantially straight forward edge 21, and a longitudinally disposed slot 26. Slot 26 is of predetermined length, having a radiused forward terminus 27 and a radiused rear terminus 29. Forward terminus 27 is disposed a predetermined distance from forward of slot 26 to approximately the width of jaws 12. The interior surfaces of side panels 22 and 24, and preferably web 20, are highly polished to present a smooth, corrosion-resistant surface to facilitate sliding movement of jaws 12. If desired, a spring 36 may be integrally formed at the distal end. Spring 36 would cooperate with cams in the base (tang) of ancillary tools 18. Handles 14 are suitably formed of a corrosion resistant, temperable material such as stainless steel, manifesting appropriate resiliency at spring 36.

Figure 1:
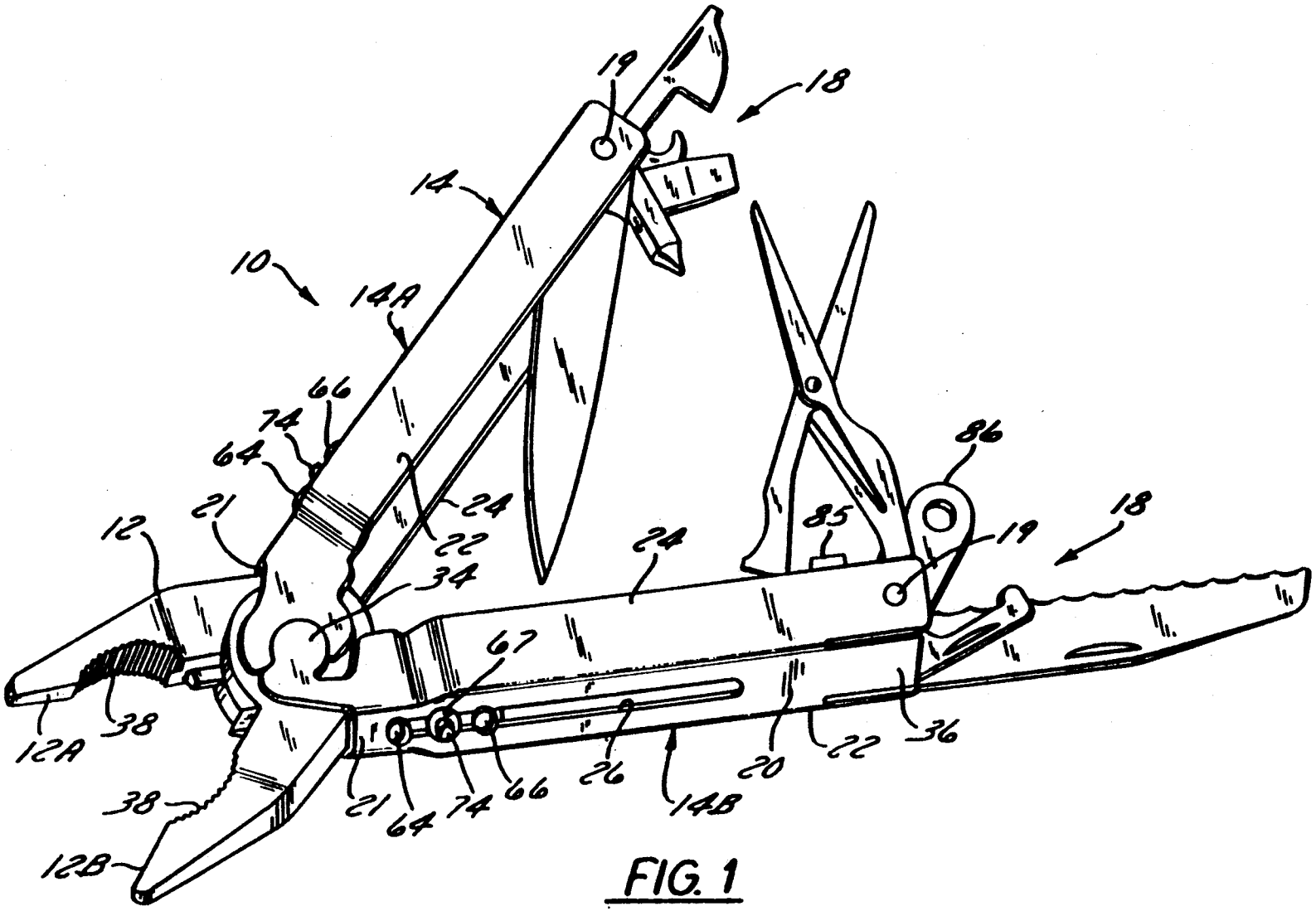
FIG. 1 is a pictorial illustration of a first embodiment of tool in accordance with the present invention, with jaws exposed, handles open, and with ancillary tools exposed for viewing.

Side panels 22 and 24 are generally planar, but conform to the configuration of web 20, i.e., are transversely stepped in the vicinity of slot forward terminus 27. Respective arms 28 and 30 extend side panels 22 and 24, respectively, forwardly of web forward edge 21 by a predetermined distance. Arms 28 and 30 each suitably terminate in a respective portion of a pivot connection, e.g., an aperture to receive a pivot pin (FIGS. 2–4) or a component of a flattened ball and socket mechanism (FIG. 1). Arms 28 and 30 suitably dispose the pivot axis at a predetermined distance $D_x$ (FIG. 4) e.g., approximately 0.312 inch longitudinally forward of web forward edge 21, and a predetermined distance $D_y$ (FIG. 4) e.g., approximately 0.506 inch, vertically offset from the interior surface of web 20 to align the handle pivot axis with that of jaws 12 when jaws 12 are in the extended position. Predetermined distance $D_x$ is chosen to ensure that web forward edge 21 does not interfere with or limit the pivotal travel of jaws 12 with the jaws in the fully extended position. Arms 28 and 30 suitably extend at an angle $\theta$ (FIG. 4), e.g., 30°, with respect to the longitudinal axis of handle 14.

In assembly, handles 14 are disposed with their respective open channels facing and, preferably pivotally connected: side panel 22A is disposed substantially in the same plane as side panel 24B; side panel 24A is disposed in substantially the same plane as side panel 22B; and separate but axially aligned pivotal connections 32 and 34, respectively, are effected between arm 28A and arm 30B and between arm 30A and arm 28B. Pivotal connections 32 and 34 can be effected in any conventional manner, such as, for example, employing a flattened ball and socket mechanism (FIG. 1), or employing a pin, e.g., rivet (FIGS. 2–4). To facilitate use of a rivet, or other fastener, arm 28 can be disposed further from the longitudinal axis of the handle than extension 30, by a distance approximating the thickness of the arms. Thus, in assembly, in the embodiment of FIGS. 2–4, extensions 28 are offset from extensions 30, with extensions 30 disposed interiorly of extensions 28.

If desired, arms 28 and 30, or pivotal connections 32 and 34 therebetween, can be omitted. However, the inclusion of arms 28 and 30 and pivotally connecting handles 14, tends to maintain handles 14 in position while jaws 12 are sliding between a fully retracted and fully extended position, and to aid in locking handles 14 in the closed position when jaws 12 are retracted, as will be explained. Arms 28 and 30 also provide support against torsional forces on jaws 12 which may be generated during use of jaws 12.

Jaws 12 comprise respective suitably configured pivotally connected individual members (jaws) 12A and 12B, each including a tang disposed rearwardly of the pivotal connection, and a working portion for, e.g., gripping or cutting, disposed forwardly of the pivotal connection. The pivotal connection of jaws 12 is at least slidably disengageable, and preferably separate, from the pivotal connection of handles 14. Jaws 12 are suitably made of a corrosion resistant material such as stainless steel, with side surfaces, and, preferably the outer exterior top and bottom highly polished to facilitate sliding relative to handles 14, and are of a weight sufficient to facilitate forward sliding movement of jaws 12 and locking of jaws 12 in extended position in response to inertial force, without creating excessive stopping inertia.

Jaws 12 are slidably connected to handles 14 preferably configured to slidingly engage handles 14 with a slip fit at all adjacent surfaces, top, bottom and sides irrespective of the position of jaws 12 relative to handles 14, i.e., in the fully extended, fully retracted and all intermediate positions.

Figure 5:
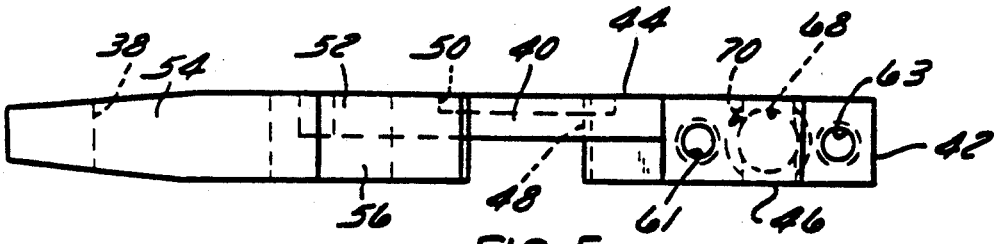
FIG. 5 is a top view of a suitable pliers jaw.
Figure 6:
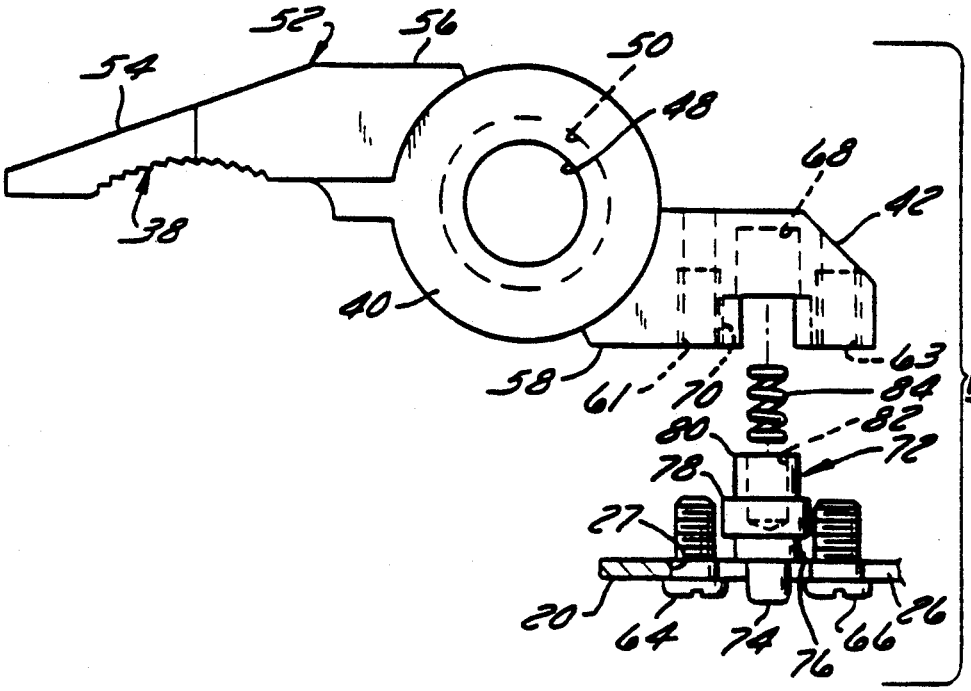
FIG. 6 is a schematic side view of the pliers jaw of FIG. 5, with the locking mechanism shown in exploded view.

Jaws 12 may comprise, for example, gripping (pliers) jaws, cutting jaws, scissor blades, or the like. Referring now to FIGS. 3, 5 and 6, suitable jaws 12A and 12B in the form of pliers will be described in terms of generically denominated components. When reference is made to a component associated with a particular one of jaws 12A and 12B, an "A" or "B" suffix, respectively, will be used. Jaws 12 are suitably of unitary construction including an elongate working portion, e.g., in the case of pliers, gripping portion 38, a generally circular recessed pivot bearing portion 40, and a handle stub (tang) 42. A first generally flat side 44 is formed by corresponding surfaces of gripping portion 38, bearing portion 40, and tang 42. A second generally flat opposing side 46 is defined by the opposing surfaces of gripping portion 38 and tang 42. Bearing portion 40, however, is only approximately one-half of the thickness of gripping portion 38 and tang 42 and is recessed with respect to side 46. A central axial bore 48 is provided in bearing portion 40, with a counterbore 50 formed in side 44.

Gripping portion 38 suitably includes an intermediate portion 52 proximate bearing portion 40, and a nose 54. Nose 54 may be of any desired configuration that, in assembly, is amenable to a sliding fit within the handle channel and may include, for example, wire cutters. The outer extremities (height) of jaw 12, however, are preferably a flat outer surface 56 of intermediate portion 52 and a flat outer transverse surface 58 of tang 42, respectively, disposed in opposing planes and approximately tangential to the outer surface of bearing portion 40 at the perpendicular to the longitudinal center of bore 48.

In assembly, jaws 12A and 12B are pivotally connected. The interior surfaces of bearing portions 40 are disposed adjacent one another with bores 48 in registry. Sides 44A and 46B and sides 44B and 46A are substantially coplanar. The upper and lower extremities of the assembly, when closed, are established by gripping portion transverse surfaces 56 and tang outer transverse surfaces 58; outer transverse surfaces 56A of gripping portion 38A and 58B of tang 42B, and outer transverse surfaces 56B and 58A substantially lie in the same plane. The pivotal interconnection is effected by, e.g., a bolt 60 and a nut 62 or a rivet flush mounted within counterbores 50 (FIG. 2).

Jaws 12 are adapted to be moved relative to handles 14 between an extended position, and a retracted position. In the extended position jaw gripping portions 38 are disposed forward of handles 14 and are capable of pivotal movement with respect to each other in response to divergence and convergence of handles 14, i.e., open and close in response to operation of handles 14. In their retracted position gripping portions 38 are at least partially, and preferably substantially, contained within the channels of handles 14, and handles 14 are, in effect, locked in a closed position. Referring now to FIGS. 3, 4, and 6, tangs 42 are slidably coupled to handles 14, disposed within handle channels, with exterior transverse walls 58 adjacent the interior surfaces of webs 20 and side walls 44 and 46 adjacent parallel side panels 22 and 24. Respective threaded holes 61 and 63 are formed in tang 42 extending inwardly from outward surface 58. Tangs 42 are slidably affixed within handles 14 by respective fastening pins, e.g., shoulder bolts 64 and 66, disposed in slot 26 and threadedly received in holes 61 and 63. Jaws 12, when closed, may thus slide relative to handles 14 within the limits defined by slots 26.

The relative position of jaws 12 and handles 14 with the jaws in the extended (active) position, is suitably established by slot forward terminus 27. In the extended position, as shown in FIGS. 2 and 3 and as will hereinafter be more fully explained, jaws 12 are slidably locked with respect to handles 14. Terminus 27 is preferably disposed at a predetermined distance from forward edge 21 of web 20 slightly less than the distance from the outer diameter of the shoulder of screw 64 to the juncture of tang surface 58 with bearing portion 40. With the tangs disposed with screw 64 at forward terminus 27 of slot 26, jaws 12 are in the fully extended position: Gripping portion 38, and preferably bearing portions 40, are fully exposed, with bearing portions 40 located just forward of edge 21 of web 20; and the axis of pliers jaw pivot 48 is in registry with the axis of handle pivots 32 and 34. Since in the fully extended operating position jaws 12 are slidably locked, and preferably, the transverse surface of bearing portions 40 and outer transverse surfaces 56 of gripping portions 38 are exposed and the axes of jaw pivot 48 and handle pivots 32 and 34 are aligned, movement of surface 56 beyond the planes of tang transverse surfaces 58 (i.e., the plane of handles 14) is unobstructed. Relative pivotal motion of jaws 12 can therefore be effected by urging handles 14 away from and toward each other.

As previously noted, the channel between sides 22 and 24 is narrowed in the vicinity and forward of terminus 27 of slot 26 to approximately the width of jaws 12, i.e., side panels 22 and 24 are stepped. Arms 28 and 30 are thus closely adjacent to sides 44 and 46 of jaws 12, and provide support against torsional forces, after encountered in the use of jaws 12. Handles 14 are wider to the rear of forward slot terminus 27 to make the handles more comfortable in use, and to accommodate disposition of ancillary tools 18 between the interior surfaces of sides 22 and 24 of handle 14 and sides 44 and 46 of jaws 12, when the jaws are retracted.

Retracting jaws 12 effectively locks handles 14 in a closed position. The length of slot 26 is chosen such that with the shoulder of screw 66 against the rear terminus 29 of slot 26, at least a portion of transverse surface 56 underlies web 20, i.e., is rearward of edge 21, and preferably, such that jaws 12 are substantially contained between side panels 22 and 24, and arms 28 and 30. With jaws 12 retracted, web 20 precludes pivotal movement of transverse surfaces 56 beyond the plane of the corresponding tang transverse surface 58. Jaws 12 are thus prevented from opening. This, in turn, prevents tangs 42, and hence handles 14, from diverging. In addition, with jaws 12 withdrawn from the extended position, the axes of jaw pivot 48 and handle pivots 32 and 34 are misaligned. This, too, tends to prevent opening of handles 14. Thus, retracting jaws 12 effectively locks handles 14 together in a closed position.

A mechanism is also provided to releasably lock jaws 12 in the fully extended position. Referring to FIGS. 3–6, a bore 68 and counterbore 70 are formed in tang 42 extending inwardly from surface 58 between threaded holes 61 and 63. An aperture 67 (FIG. 2) having a diameter greater than the width of slot 26 but less than the diameter of counterbore 70 is formed communicating and preferably concentrically slot 26. Aperture 67 is disposed to overlie bore 68 when jaws 12 are in a fully extended position.

A stepped diameter pin 72 is received within bore 68 and slot 26. Pin 72 includes a first (small diameter) portion 74 of a diameter slightly less than the width of slot 26, a second (intermediary diameter) portion 76 of a diameter greater than the width of slot 26, but slightly less than the diameter of slot aperture 67, a third (large diameter) portion 78 of a diameter corresponding to that of counterbore 70 (greater than the diameter of slot aperture 67), and a fourth portion 80 of a diameter corresponding to that of bore 68. The combined thickness of portions 76 and 78 of pin 72 are no more than the depth of counterbore 70. An axial bore 82 is formed in pin 72, extending inwardly through portion 80, to partially receive a biasing spring 84. It is desirable that pin 72 and, in particular, portions 76 and 78 be of relatively large diameter for strength. In this regard, the diameter of portion 78, and of counterbore 70, may be greater than the width of tangs 42.

In assembly, spring 84 and portion 80 of pin 72 are received within bore 68, and large diameter portion 78 within counterbore 70. When jaws 12 are brought to the fully extended position by for example imparting an inertial force to the tool, bore 68 underlies slot aperture 67 and intermediate diameter portion 76 of pin 72 is received in slot aperture 67, with the ledge of large diameter portion 78 biased against the interior surface of web 20 by spring 84. When intermediate diameter portion 76 is received within slot aperture 67, jaws 12 are slidably locked relative to handle 14. Accordingly, and is more fully explained below, only one hand is needed to bring jaws 12 to an operating position.

To unlock and retract jaws 12, portion 74 of pin 72 is depressed, overcoming the bias of spring 84, to cause intermediate diameter portion 76 to recede into tang counterbore 70. Plier jaws 12 can then be retracted, with small diameter portion 74 of pin 72 slidably received within slot 26, and the ledge of intermediate diameter portion 76 biased by spring 84 against the underside of web 20. As was required to bring jaws 12 to the operating position, only one hand is needed to retract jaws 12 into handles 14; the user depresses small diameter portions 74 with, for example, thumb and forefinger, and slides jaws 12 relative to handles 14 to a retracted position.

Friction is normally sufficient to maintain jaws 12 in a retracted position, as against casual forces typically encountered in the transport of tool 10. However, if desired, an additional aperture 69, similar to aperture 67, an be provided toward the rear of slot 26 for locking jaws 12 in the retracted position.

Jaws 12 can be exposed and locked in operating position using only one hand. For example, handles 14 can be held in the palm of the hand and one of screws 64, or 66, or actuator pin small diameter portion 74, pushed forward with, e.g., the thumb, to move jaws 12 into the extended position. Alternatively, jaws 12 can be exposed and locked into a fully extended operating position by holding side panels 22 and 24 in the fingers and generating sufficient inertial or centrifugal force as by, for example, a flick of the wrist, causing jaws 12 to slide forward relative to handles 14. As previously noted, jaws 12 are of sufficient weight to facilitate movement by inertial force, while at the same time not so great as to cause excessive inertial stopping force that might damage shoulder bolts 64 and 66. In addition, sides 44 and 46 of jaws 12 and, preferably, transverse surfaces 56 and 58, as well as the interior surfaces of panels 22 and 24 and, preferably, web 20 of handles 14, are highly polished to facilitate sliding.

Ancillary tools 18 are suitably pivotally mounted to the distal ends of handles 14. Tools 18 are suitably formed of a corrosion resistant, temperable material such as stainless steel having sufficient carbon content to provide edge retention properties, as well as wear resistance in the vicinity of the tang. The tangs (bases) of each of the individual tools 18 are suitably cammed to cooperate with spring 36. When folded into handle 14, the tool resides either rearward of tangs 42 with pliers 12 in a fully retracted position, or in a space between sides 44 and 46 of jaws 12 and side walls 22 and 24. The particular selection of ancillary tools 18 is arbitrary. However, the tool selection would typically be in accordance with the intended use of tool 10, i.e., tools typically used by an outdoorsman, electrician, hunter, etc.

Figure 7:
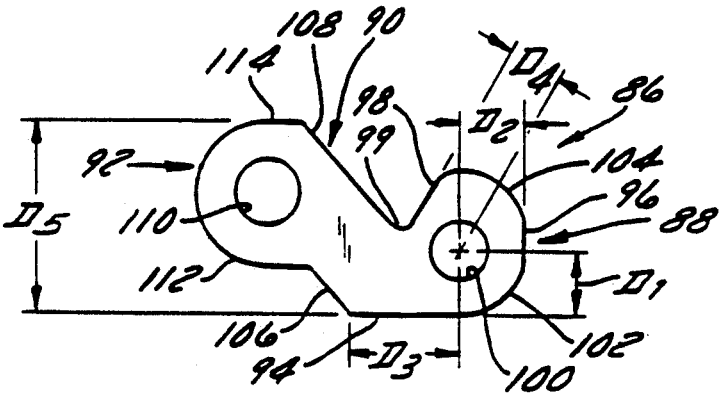
FIG. 7 is a side view of a suitable stop/lanyard eye.

It is desirable that a stop mechanism be provided at the distal end of handles 14, to establish a nominal minimum separation between the distal ends of handles, i.e., to ensure that handles 14 are not squeezed together to the extent that sliding movement of jaws 12 is restricted. It is also desirable that the stop mechanism be resilient and subject to override by application of sufficient force to ensure tight closure of jaws 12. Such a stop mechanism suitably comprises one or more ancillary tools 18 which extend upwardly beyond the inner edge of side panels 22 and 24 disposed to abut against either a cooperating stop, or other ancillary tools 18 disposed in the opposing handle 14. Referring to FIGS. 1 and 7, such a stop, 86 may be provided by a lanyard receiver 86.

Lanyard receiver 86 is generally planar, of constant transverse width, and as best seen in FIG. 7, comprises a tang 88, an arm 90, and an eye 92. Tang 88 includes an interior through bore 100, and preferably, is calmed. Three primary dispositions are established, (nested (stop); opening bias; and exposed) employing respective peripheral transverse surface cam flats 94, 96 and 98, interconnected by curved peripheral transverse portions 102 and 104. Curved portions 102 and 104 are concentric with bore 100 and of predetermined radii, e.g., 0.200 inch and 0.224 inch, respectively.

Flat 94 resides adjacent to spring 36 when receiver 86 is in the nested (closed) position, disposed outwardly from the center of bore 100 by a predetermined height $D_1$, e.g., 0.190 inch. Distance $D_1$ corresponds to the distance from the center of post 19 to the inner surface of spring 36 (FIG. 1) with spring 36 relaxed. Flat 94 extends longitudinally a predetermined distance $D_3$, e.g., 0.3 inch, forward of the center of bore 100. Distance $D_3$ is chosen to dispose the forward end of flat 94 a predetermined distance from the end of spring 36 corresponding to a desired spring bias against receiver 86 in response to outward pressure on eye 92.

Flat 96 resides adjacent to spring 36 when receiver 86 is in the opening bias position, suitably disposed at approximately 90° relative to flat 94, coupled to flat 94 by curved portion 102. Flat 96 is disposed at a predetermined longitudinal distance $D_2$, e.g., 0.194 inch, slightly greater than distance $D_1$, from the center of bore 100.

Flat 98 resides adjacent to spring 36 when receiver 86 is in the exposed position, disposed at a predetermined angle, e.g., 45°, relative to a line parallel to flat 94, coupled to flat 96 by curved portion 104. Flat 98 is also disposed at distance $D_4$ along a perpendicular radially from the center of bore 100.

Undercut 99 provides clearance for the end of spring 36 during pivoting of receiver 86 into and out of the exposed position. Undercut 99 suitably comprises an additional flat extending at a predetermined angle from flat 98, e.g., 30° (75° from flat 94).

Arm 90 couples eye 92 to tang 88, and is disposed at a predetermined angle, preferably 90°, with respect to flat 98. First and second transverse surfaces 106 and 108, extend forwardly from the ends of flat 94 and undercut portion 99, respectively. When receiver 86 is in the exposed position surface 108 abuts the end of spring 36. The length and angle of arm 90 are chosen in accordance with the desired positions of eye 92 when receiver 86 is in its various positions.

Eye 92 includes an interior through bore 110, a concentric curved peripheral portion 112, and a flattened peripheral portion 114. Flat 114 is generally parallel to, and at a predetermined distance $D_5$ from, tang flat 94, e.g., 0.545 inch. Distance $D_5$ is greater than the height of handle sides 22 and 24 by an amount in accordance with the desired minimum separation. The center of eye bore 110 is offset, both longitudinally and in height, from the center of tang bore 100 by predetermined distances, e.g., 0.562 and 0.155 inch, respectively.

In assembly, post 19 is journaled through tang bore 100 to pivotally mount lanyard receiver 86 in the distal end of, e.g., handle 14B. In the nested position, flat 94 is disposed adjacent to, and bearing against, the inner surface of spring 36B. Eye flat 114 abuts against an opposing stop, or against one or more ancillary tools 18 in opposing handle 14A. Thus, a nominal minimum handle separation is established. However, when jaws 112 are in the extended position, it may be desirable in some instances to force handles 14 closer together than the nominal minimum to, for example, close jaws 12 tightly on a thin object. Such instances are accommodated by receiver 86. Converging force on handles 14 tends to rotate receiver 86 counter-clockwise about post 19, causing the juncture of flat 94 and arm surface 106 against spring 36. If sufficient force is exerted on handles 14 to overcome the bias of spring 36, moving it outwardly, handles 14 are permitted to move closer than the nominal minimum.

Receiver 86 can also be used to provide an opening bias for jaws 12. With receiver 86 pivoted into the opening bias position, with flat 96 adjacent spring 36, the rounded portion 112 of eye 92 is suitably disposed underlying a rounded bearing surface disposed on the distal end of the opposing handle 14, such as the rounded portion (e.g., corresponding to portion 104 of lanyard receiver 86) of the tang of an ancillary tool 18 in the opposing handle 14A. As handles 14 are forced together beyond the point of contact between eye rounded portion 112 and the rounded portion of the tang of the opposing tool, rounded portion 112 rides on the bearing surface, causing receiver 86 to pivot in a clockwise direction. This moves flat 96 off of spring 36 and rounded portion 104 bears against spring 36, moving it outward. If sufficient converging force is not present to overcome the bias of spring 36, i.e., the user ceases to squeeze the handles together, spring 36 causes receiver 86 to rotate in the counter-clockwise direction. This causes rounded surface 112 to push up on the bearing surface of opposing handle 14A and open jaws 12 by a small amount.

Figure 8:
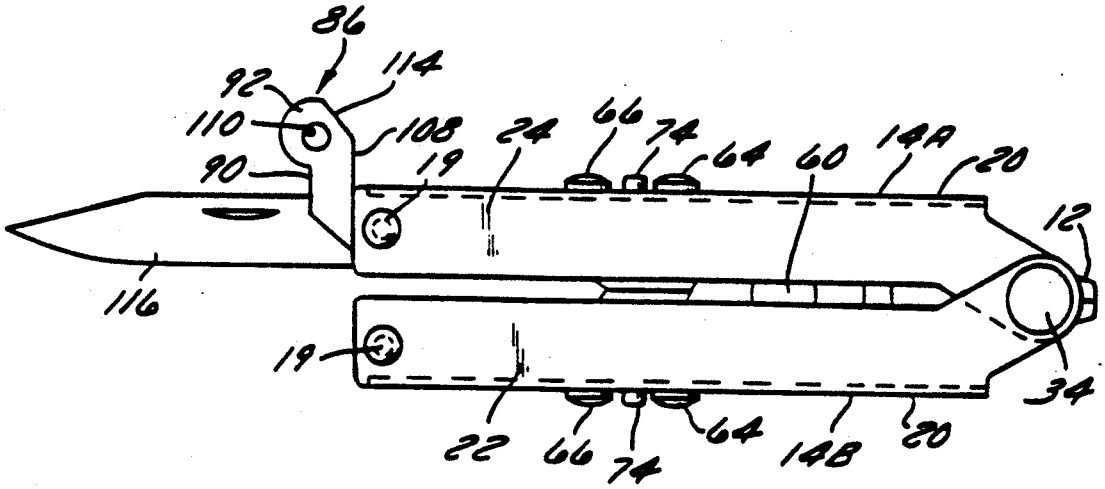
FIG. 8 is a schematic side view of the tool of FIGS. 2–4 with a knife blade and lanyard receiver exposed.

When receiver 86 is rotated in a clockwise direction into the exposed position (flat 98 adjacent spring 36), eye 92 is disposed to receive a lanyard without interfering with the operation of other ancillary tools. Referring now to FIG. 8, when flat 98 is adjacent spring 36, arm 90 is disposed at approximately 90° with respect to the longitudinal axis of handles 14. Eye 92 is thus disposed exteriorly of web 20. Thus, the lanyard may be routed through eye bore 110, without interfering with the opening or closing of other ancillary tools 18 disposed transversely adjacent to receiver 86 such as, for example, a knife blade 116.

In the exposed position, lanyard receiver 86 also serves as a quillon with respect to blade 116 and eye flat 114 provides a particularly comfortable brace for a user's thumb, when exerting cutting pressure on blade 116.

It will be understood that the above description is of preferred exemplary embodiments of the present invention, and that the invention is not limited to the specific forms shown. For example, in the preferred embodiment the pivotal connection of jaws 12 is separate from the pivotal connection of handles 14. Alternatively, jaws 12 and handles 14, may share a common pivotal connection when jaws 12 are in the extended position, from which one or the other disengages to facilitate retraction. In this regard, jaws pivot pin 60 may be extended transversely outward from jaw sides 44 and 46, and cooperating slots provided in arms 28 and 30; the pivot aperture in arms 28 and 30 would be open, forming a partial, e.g. half, circle opening to the rear. The projecting ends of extended pin 60 would engage the slots in arms 28 and 30 when in a fully extended position. By way of another example, slots 26 could be disposed in one of side panels 22 or 24, rather than web 20. In such case, shoulder screws 64 and 66 could, if desired, be eliminated. Alternative mechanisms for slidably affixing tangs 42 to handles 14 may also be employed. Likewise, while it is advantageous and preferred to provide locking mechanisms in both handles 14, if desired, the locking mechanism can be omitted altogether, locking pin 72 employed only in one of handles 14, or some alternative form of locking mechanism employed. These and other modifications may be made in the design and arrangement of the elements within the scope of the invention, as expressed in the claims.

We claim:

1. A tool with retractable cross-jaws capable of being moved into an exposed operating position by imparting inertial force to the tool, said tool comprising:

first and second jaws, each including a working portion and a tang interconnected by a bearing portion, said jaws being pivotally connected at said bearing portions to form said cross-jaws;

first and second handles, each including an internal channel therein;

means for slidably coupling said tangs to said handles for selective movement within said handle channels whereby said jaws can be moved between an exposed operating position and a retracted position; and releasable biasing means for locking said jaws in said operating position in response to an inertial force imparted to the tool.

2. The tool of claim 1 wherein at least one of said handles includes said biasing means.

3. The tool of claim 1 wherein said inertial force is imparted to the tool by a flick of the wrist.

4. The tool of claim 1, further comprising means for effecting a pivotal connection between said handles at least separable from said connection between said jaws, said connection between said handles having a pivotal axis aligned with the axis of the pivotal connection between said jaws when the jaws are in said extended position.

5. The tool of claim 1, wherein said handle includes a web and respective side panels, said web interconnecting said side panels to define said handle channel.

6. The tool of claim 5, wherein said working portion of each of said jaws includes a generally flat outer transverse surface proximate said bearing portion, and said tang includes a generally flat outer transverse surface.

7. The tool of claim 6, wherein the working portion outer transverse surface of one of said jaws and the tang outer transverse surface of the other of said jaws substantially lie in a same plane when said jaws are in closed position.

8. The tool of claim 7 wherein, when said jaws are in said retracted position, said webs preclude pivotal movement of said working portion outer transverse surfaces substantially beyond said plane, thereby preventing said jaws from opening.

9. The tool of claim 7 wherein, when said jaws are in said retracted position, said webs of said handle channels substantially interfere with the pivotal travel of said working portion outer transverse surfaces, thereby preventing said handles from diverging.

10. The tool of claim 1, further including at least one ancillary tool pivotally mounted to the distal end of one of said handles.

11. The tool of claim 1, wherein said means for slidably coupling comprises at least one longitudinal slot of predetermined width formed in one of said handles, and a fastener coupled to the tang disposed in the handle channel, said fastener including a portion extending through said slot, disposed for sliding movement therein.

12. The tool of claim 1, further comprising means for releasably locking said jaws in said retracted position.

13. A tool with retractable jaws capable of being moved into an exposed operating position by a single hand, said tool comprising:

first and second jaws, each including a working portion and a tang interconnected by a bearing portion, said jaws being pivotally connected at said bearing portions;

first and second handles;

means for slidably coupling said tangs to said handles for selective movement relative to said handle between extended and retracted positions, said jaws being of sufficient weight to facilitate forward sliding movement of said tangs; and means for exposing and locking said jaws in said extended position by imparting an inertial force to the tool.

14. The tool of claim 13, further comprising means for effecting a pivotal connection between said handles, said connection between said handles having a pivotal axis aligned with the axis of the pivotal connection between said jaws when the jaws are in said extended position.

15. A tool with retractable jaws capable of being moved into an exposed operating position by a single hand, said tool comprising:

first and second jaws, each including a working portion and a tang interconnected by a bearing portion, said jaws being pivotally connected at said bearing portions;

first and second handles;

means for slidably coupling said tangs to said handles for selective movement relative to said handle between extended and retracted positions, said jaws being of sufficient weight to facilitate forward sliding movement of said tangs; and means slidably locking said jaws in said extended position to said handles within when said jaws are in said extended position free relative pivotal movement of said jaws, in response to convergence or divergence of said handles, is maintained.

16. A tool with retractable cross-jaws capable of being moved into an exposed operating position by imparting inertial force to the tool, said tool comprising:

first and second jaws, each including a working portion and a tang interconnected by a bearing portion, said jaws being pivotally connected at said bearing portions to form said cross-jaws;

first and second handles, each including an internal channel therein;

means for slidably coupling said tangs to said handles for selective movement within said handle channels whereby said jaws can be moved between an exposed operating position and a retracted position, said jaws being of sufficient weight to facilitate forward sliding movement of said jaws; and releasable locking means locking said jaws in said operating position in response to an inertial force imparted to the tool.

* * * * *